US012643029B2

(12) United States Patent
Zhou

(10) Patent No.: US 12,643,029 B2
(45) Date of Patent: Jun. 2, 2026

(54) THROWING TRAINING DEVICE

(71) Applicant: Xingyu Zhou, Ji'an (CN)

(72) Inventor: Xingyu Zhou, Ji'an (CN)

( * ) Notice: Subject to any disclaimer, the term of this patent is extended or adjusted under 35 U.S.C. 154(b) by 403 days.

(21) Appl. No.: 18/406,365

(22) Filed: Jan. 8, 2024

(65) Prior Publication Data

US 2025/0186849 A1 Jun. 12, 2025

(30) Foreign Application Priority Data

Dec. 12, 2023 (CN) ..... 202323386534.6

(51) Int. Cl.
*A63B 69/00* (2006.01)
*A63B 63/08* (2006.01)
*A63B 63/00* (2006.01)

(52) U.S. Cl.
CPC ..... *A63B 69/0071* (2013.01); *A63B 63/083* (2013.01); *A63B 2063/001* (2013.01); *A63B 2210/50* (2013.01); *A63B 2225/093* (2013.01); *A63B 2243/0033* (2013.01); *A63B 2243/0066* (2013.01)

(58) Field of Classification Search
CPC ..... A63B 69/0071; A63B 63/083; A63B 2063/001; A63B 2210/50; A63B 2225/093; A63B 2243/0033; A63B 2243/0066; A63B 63/06; A63B 69/0002; A63B 71/022; A63B 71/023; A63B 2225/09
USPC ..... 473/416, 432–435, 447–449, 472, 473/479–489
See application file for complete search history.

(56) References Cited

U.S. PATENT DOCUMENTS

| | | | | | |
|---|---|---|---|---|---|
| 5,133,546 | A * | 7/1992 | Matherne | A63B 24/0021 | 273/375 |
| 5,273,275 | A * | 12/1993 | Wilkerson | A63B 69/0071 | 473/433 |
| 5,692,976 | A * | 12/1997 | Yu | A63B 69/0071 | 473/433 |
| 6,224,504 | B1 * | 5/2001 | Tien | A63B 63/083 | 473/433 |
| 7,247,105 | B2 * | 7/2007 | Huntsberger | A63B 57/357 | 473/433 |
| 9,533,210 | B2 * | 1/2017 | Lee | A63B 71/0054 | |
| 10,603,559 | B1 * | 3/2020 | Farley | A63B 69/0071 | |
| 10,813,447 | B2 * | 10/2020 | Tsai | A47B 25/00 | |
| 11,344,777 | B2 * | 5/2022 | Wang | A63B 63/083 | |
| 2006/0040770 | A1 * | 2/2006 | Chou | A63B 69/0071 | 473/433 |

* cited by examiner

*Primary Examiner* — Nini F Legesse
(74) *Attorney, Agent, or Firm* — JEEN IP LAW, LLC

(57) ABSTRACT

The present application provides a throwing training device, which includes a frame, a lifting seat, and a hinged component. The hinged component is connected to the frame and the lifting seat, the hinged component is configured to fix the frame to the lifting seat and to move the frame around the hinged component. The throwing training device has an unfolded configuration and a storage configuration, which can adapt to the needs of different throwing events through a shape adjustment, and is convenience to use and transport; the throwing training device can flexibly adjust a use height by providing with the lifting seat, thereby meeting different use needs.

11 Claims, 12 Drawing Sheets

THROWING TRAINING DEVICE

CROSS-REFERENCE TO RELATED APPLICATIONS

This application claims priority to Chinese Patent Application No. 202323386534.6, filed on Dec. 12, 2023, which is hereby incorporated by reference in its entirety.

TECHNICAL FIELD

The present application relates to the field of training and entertainment equipment technologies, and in particular, to a throwing training device.

BACKGROUND

Basketball is one of the most popular ball games worldwide, with a certain requirement for the field. However, due to current limitations of urban activity venues, in order to reduce an impact on other sports or activities, many locations cannot install fixed basketball stands, which leads to inconvenience in basketball activities, training, competitions, etc.

In addition, some throwing ball sports or entertainment games, such as baseball, rugby, etc., also require a cooperation of venues and equipment for training or entertainment.

At present, US patent with the public number of U.S. Pat. No. 7,247,105B2 has disclosed a reconfigurable multi-sport gaming device that can meet the needs of various sports games, but it has a problem of inconvenient adjustment and transportation.

SUMMARY

In order to overcome the shortcomings of the existing technology mentioned above, the present application provides a throwing training device that can be used for throwing training and entertainment in indoor or outdoor, with an effect of easy folding, transportation, and flexible adjustment.

The throwing training device including:

- a frame including a connection rod component and a target component, where the target component is connected to the connection rod component; the connection rod component is configured to have an unfolded configuration and a folded configuration, so that the frame has an unfolded configuration and a storage configuration; the frame limits a proximity position of a user in the unfolded configuration and allows the user to throw an object towards the target component; the frame folds components in the storage configuration to reduce space occupation;
- a lifting seat provided below the frame, configured to lift and lower under a drive force, and synchronously drive the frame to lift and lower;
- a hinged component, where the hinged component connects the frame and the lifting seat; the hinged component is configured to fix the frame to the lifting seat and to move the frame around the hinged component.

In an implementation mode, the frame further includes a bracket, a standing frame, and a baffle; a lower end of the bracket is hinged with the hinged component, the standing frame is fixedly connected to the bracket, the baffle is provided at one surface of the standing frame, the standing frame and baffle are constructed as a main structure of the target component.

In an implementation mode, the frame includes at least one set of connection rod components, the connection rod components are provided on one side of the standing frame.

In an implementation mode, the frame includes a bottom frame for constructing a return area, the bottom frame is provided at a lower part of the frame, one end of the bottom frame is connected to the standing frame; when the frame is in unfolded configuration, the bottom frame tilts downwards with a horizontal line as a reference.

In an implementation mode, the other end of the frame far from the standing frame is provided with a blocking rod for intercepting the thrown object returned from the return area.

In an implementation mode, the frame further includes a side blocking member, the side blocking member extends from one side of the standing frame to a same side of the blocking rod.

In an implementation mode, the frame is provided with a bottom blocking member, the bottom blocking member extends along the standing frame to the blocking rod to form the return area for receiving the thrown object and returning the thrown object to the return area of the blocking rod.

In an implementation mode, the lifting seat includes a base, a lifting mechanism, and a support seat; a positioning end of the lifting mechanism is provided on an upper surface of the base, a lower surface of the support seat is connected to an upper part of a movable end of the lifting mechanism, the hinged component is provided on an upper surface of the support seat; the lifting mechanism drives the support seat to raise or lower relative to the base under an action of a drive force to adjust a position of the frame in a vertical direction.

In an implementation mode, the hinged component includes a hinged base, and a locking element and a pin that are provided on the hinged base, the hinged base is fixedly provided on the lifting seat, and the hinged base is hinged with the frame through the pin; the locking member is configured to form a connection or separation with the frame to fix or rotate the frame relative to the hinged base.

In an implementation mode, the target component further includes a basket, the basket is provided on the baffle.

In an implementation mode, the target component includes several targets, the several targets are provided on one surface of the baffle.

According to the technical solution provided by the aforementioned implementation modes, the throwing training device has at least the following advantages or effects:

(1) The throwing training device has an unfolded configuration and a storage configuration, which can be adjusted to meet the needs of different throwing events and is easy to use and transport.

(2) The throwing training device can flexibly adjust a use height by providing with the lifting seat, which can meet different use needs.

(3) The throwing training device can be used as a counterweight through the providing with the lifting seat, an overall center of gravity is caused to move downwards, and stability is improved during use.

BRIEF DESCRIPTION OF DRAWINGS

In order to provide a clearer explanation of the technical solution in the embodiments of the present application, a brief introduction will be made to the drawings required in the description of the embodiments. It is evident that the drawings are only some embodiments of the present application. For those skilled in the art, other drawings can be obtained based on these drawings without creative work.

Figure 1:
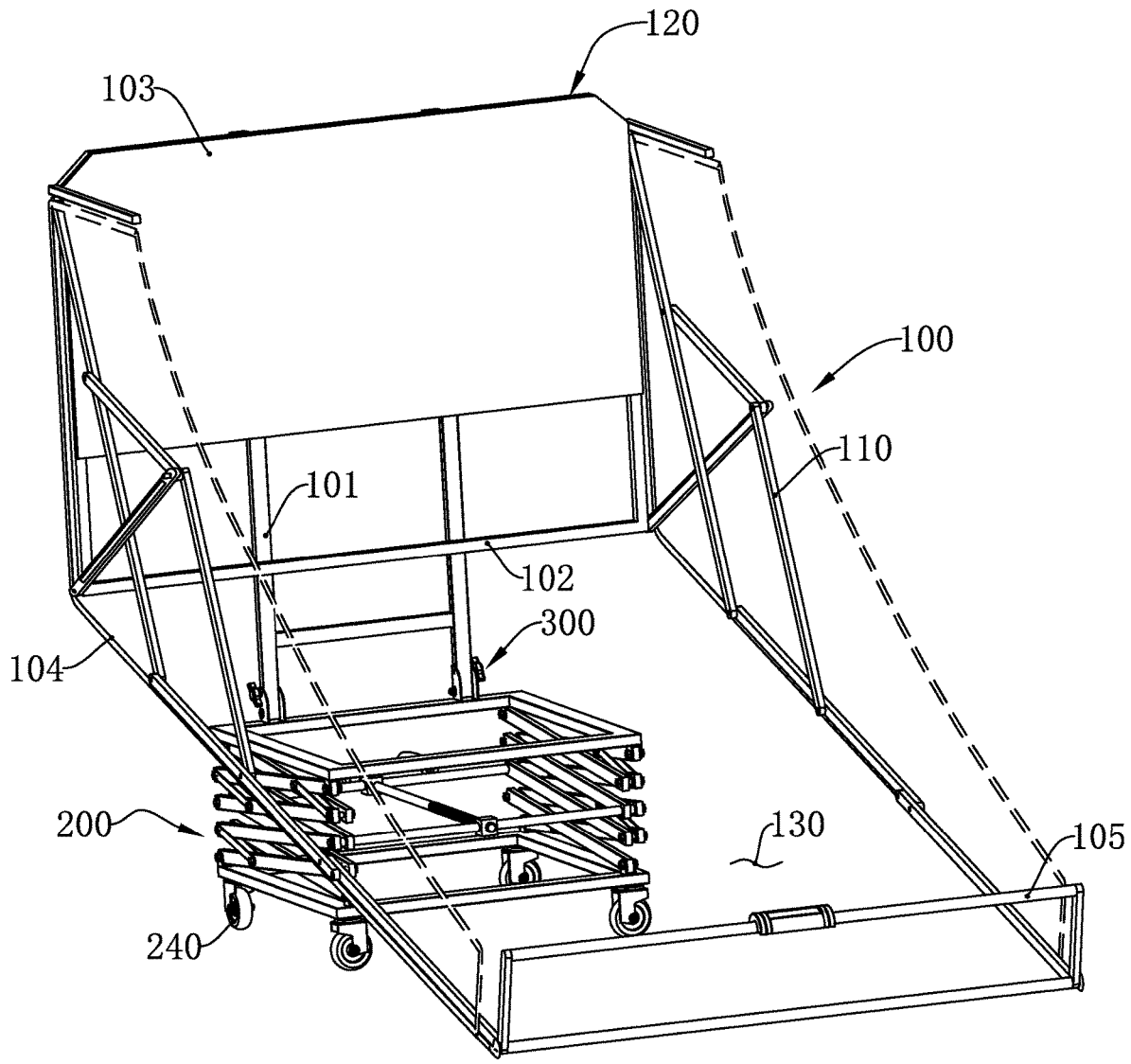
FIG. 1 is a perspective view of a throwing training device provided in the present application.

Numeral reference: 100. Frame; 200. Lifting seat; 300. Hinged component; 110. Connection rod component; 120. Target component; 130. Return area; 101. Bracket; 102. Standing frame; 103; Baffle; 111. First rod; 112. Second rod; 113. Third rod; 114. Fourth rod; 115. Fifth rod; 116. Sixth rod; 117. Seventh rod; 118. Extension part; 104. Bottom frame; 105. Blocking rod; 106. Side blocking member; 107. Bottom blocking member; 108. Front blocking member; 121. Basket; 122. Display component; 123. Target; 210. Base; 220. Lifting mechanism; 230. Support seat; 240. Wheel; 221. Main rod; 222. Lift connection rod; 223. Driven rod; 224. Drive rod; 225. Drive block; 226. Crank; 310. Hinged base; 320. Locking element; 330. Pin.

DESCRIPTION OF EMBODIMENTS

The following will provide a clear and complete description of the technical solution in the implementation method of the present application, in combination with the drawings. Obviously, the described implementation modes are only a part of the implementation method of the present application, not the entire implementation modes. Based on the implementation modes in the present application, all other implementation modes obtained by ordinary technical personnel in this field without creative work fall within the protection scope of the present application.

In this specification, terms "first", "second", etc. are only used to describe the purpose and cannot be understood as indicating or implying relative importance or implying the quantity of technical features indicated. Therefore, features limited to "first" and "second" can explicitly or implicitly include one or more of these features. In the description of the present application, unless otherwise specified, "multiple" means two or more.

In addition, in this specification, directional terms such as "up" and "down" are defined relative to the orientation of the structural schematic placement in the drawings. It should be understood that these directional terms are relative concepts used for relative description and clarification, and can change accordingly according to the changes in the orientation of the structural placement.

The present application provides a throwing training device that can be used for sports and entertainment events such as basketball, rugby, handball, etc.

Figure 2:
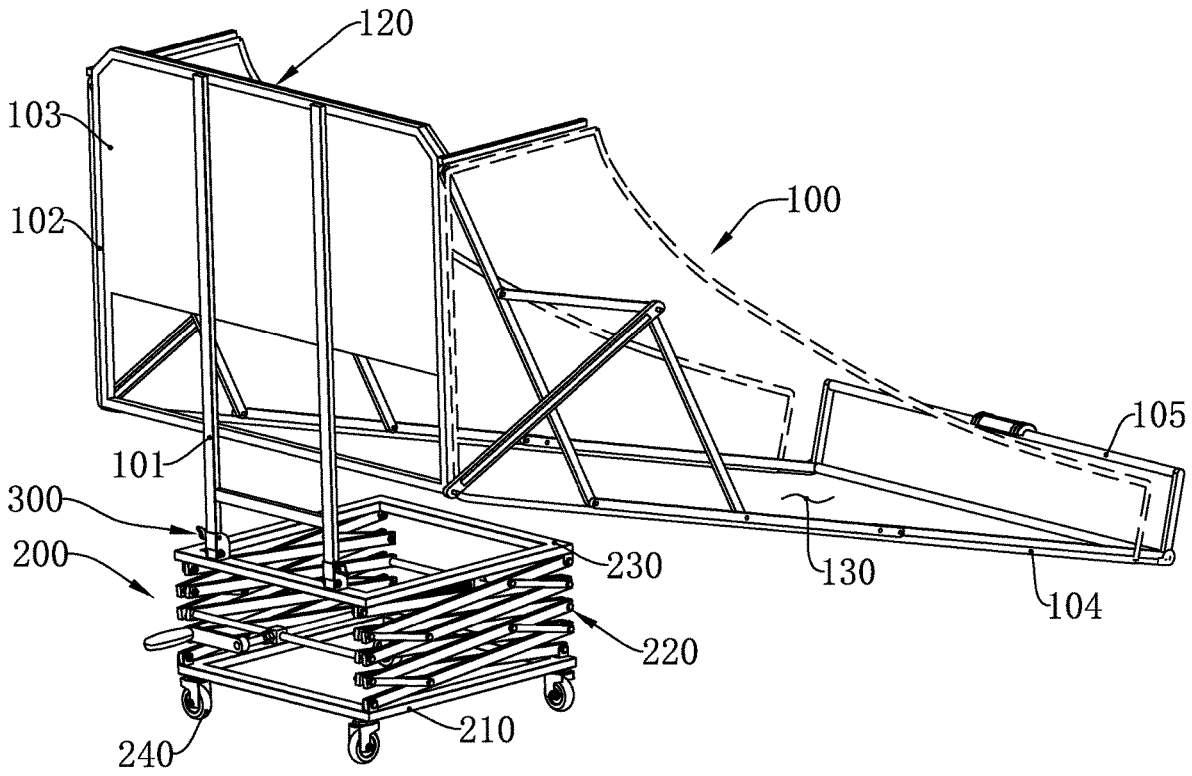
FIG. 2 is another perspective view of the throwing training device provided in the present application.
Figure 8:
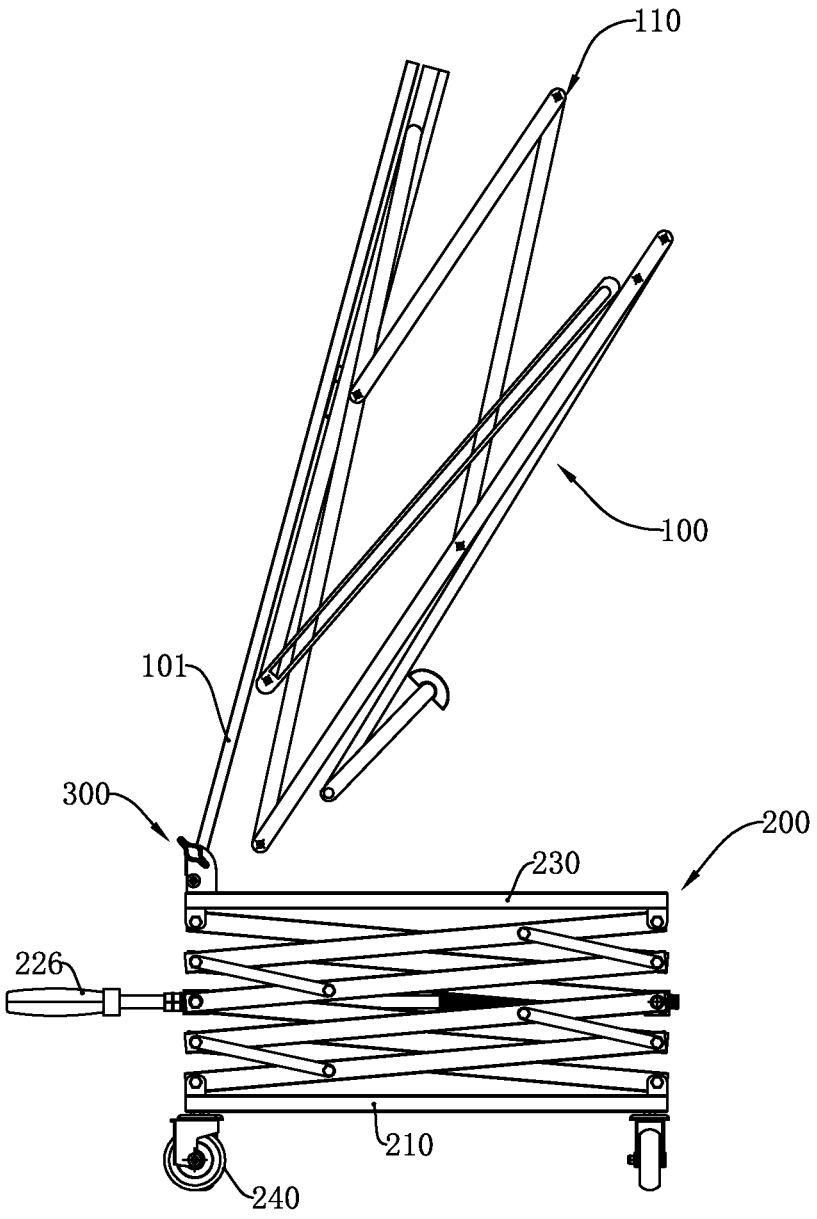
FIG. 8 is a perspective view of the throwing training device in a storage configuration provided in the present application.

As shown in FIGS. 1, 2, and 8, the throwing training device includes a frame 100, a lifting seat 200, and a hinged component 300.

The Frame 100 has a connection rod component 110 and a target component 120, the target component 120 is connected to the connection rod component 110; the connection rod component 110 is configured with an unfolded configuration and a storage configuration, so that the frame 100 has an unfolded configuration and a storage configuration. The frame 100 limits a proximity position of a user in the unfolded configuration and allows the user to throw an object towards the target component 120; the frame 100 folds components in the storage configuration to reduce space occupation.

The lifting seat 200 is located below the frame 100, and is configured to lift and lower under an action of a drive force, and synchronously drive the frame 100 to lift and lower.

The hinged component 300 connects the frame 100 to the lifting seat 200. The hinged component 300 is configured to fix the frame 100 to the lifting seat 200 and to move the frame 100 around the hinged component 300.

Where, FIGS. 1 and 2 show structural schematic of the throwing training device in the unfolded configuration, and FIG. 8 shows a structural schematic of the throwing training device in the storage configuration.

The frame 100 further includes a bracket 101, a standing frame 102, and a baffle. A lower end of the bracket 101 is hinged with the hinged component 300, the standing frame 102 is fixedly connected to the bracket 101. The baffle is provided at one side of the standing frame 102, the standing frame 102 and the baffle form a main structure of the target component 120.

Specifically, in one embodiment shown in FIGS. 1 and 2, the bracket 101 includes two vertical rods, with bottom end of the vertical rods connected to the hinged component 300, r the bracket 101 is further provided at an upper end of the lifting seat 200.

The standing frame 102 is in a structure of a frame 100, which is fixedly connected to the bracket 101 to facilitate an installation and setting of the baffle.

In the present application, the frame 100 includes at least one set of connection rod components 110, the connection rod components 110 are provided on one side of the standing frame 102.

The connection rod component 110 is a main component for folding the frame 100, which is arranged through a multi connection rod structure for easy unfolding and folding.

Figure 7:
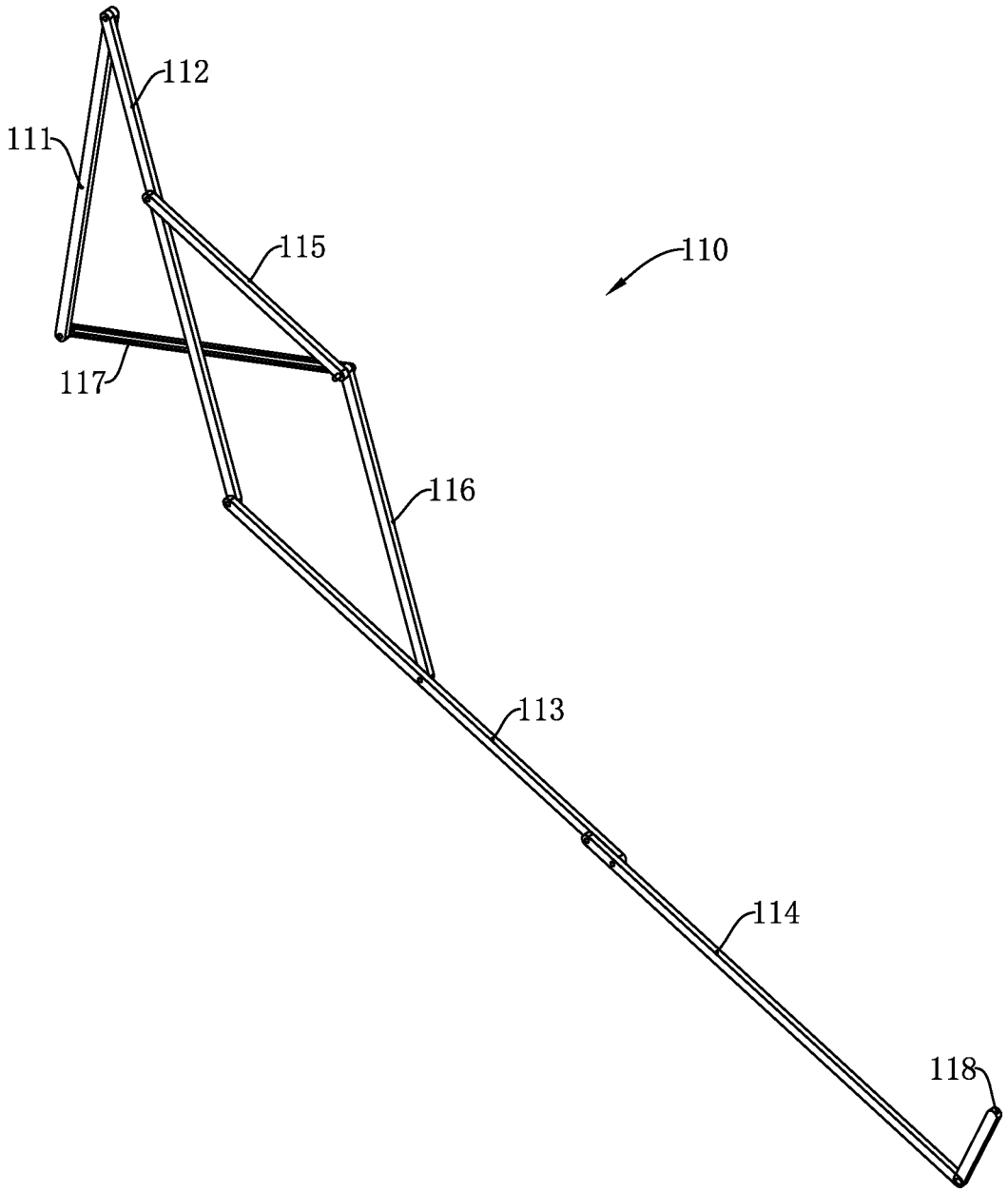
FIG. 7 is a schematic structural diagram of a connection rod component provided in an embodiment of the present application.

An implementation mode of the connection rod component 110 is provided, as shown in FIG. 7. Specifically, the connection rod component 110 includes a first rod 111; a baffle 103, a second rod 112, a third rod 113, a fourth rod 114, a fifth rod 115, a sixth rod 116, and a seventh rod 117, where the first rod 111 and the baffle 103 are fixedly connected to the standing frame 102, one end of the second rod 112 is connected to the first rod 111 and one end of the baffle 103; the other end of the second rod 112 is hinged with one end of the third rod 113, the other end of the third rod 113 is hinged with one end of the fourth rod 114, one end of the fifth rod 115 is hinged with a body of the second rod 112, the other end of the fifth rod 115 is hinged with one end of the sixth rod 116, the other end of the sixth rod 116 is hinged with a body of the third rod 113, one end of the seventh rod 117 is connected to the first rod 111 and the other end of the baffle 103; the other end of the seventh rod 117 is movably connected to one end of the fifth rod 115 that is hinged with the sixth rod 116.

As shown in FIGS. 1 and 2, the frame 100 includes a bottom frame 104 for constructing a return area 130. The bottom frame 104 is provided at a lower part of the frame 100, one end of the bottom frame 104 is connected to the standing frame 102; when the frame 100 is in the unfolded configuration, the bottom frame 104 tilts downwards with a horizontal line as a reference.

The return area 130 is configured to receive a dropped object such as basketball and return it to a predetermined position after the user throws it to the target component 120.

When users engage in throwing training or gaming, the unfolded frame 100 can limit the closest throwing position of the user. Specifically, a distance extending from the bottom frame 104 to the standing frame 102 is the closest throwing distance that the user is restricted from. When the frame 100 is in the unfolded configuration, the user throws a thrown object towards the target component 120, and the thrown object falls into the return area 130. By the bottom frame 104 that is arranged titled downwards, gravity drive can be achieved on the thrown object, thereby allowing the thrown object in the return area 130 to move freely from one end of the target component 120 to the other end where the user is located, and facilitating the user to retrieve the thrown object again.

As shown in FIG. 1, in order to prevent the thrown object from falling, the frame 100 is provided with a blocking rod 105 for intercepting the thrown object returned from the return area 130 at the other end far away from the standing frame 102.

Specifically, in the embodiment of the present application, the connection rod component 110 is provided with two sets, which are respectively provided at two vertical sides of the standing frame 102 to achieve a structural stability.

In the implementation mode of the connection rod component 110 provided above, the other end of the fourth rod 114 is movably provided with an extension part 118, the extension part 118 forms a movable hinge with the body of the fourth rod 114. The extension part 118 can be rotated according to the use or storage situation to form a required angle.

In the embodiment modes shown in FIGS. 1 and 2, two ends of the blocking rod 105 are respectively connected to ends of the extension part 118 of the fourth rod 114 in two sets of connection rod component 110, thereby forming a blocking structure for intercepting the thrown object. When it is necessary to store the throwing training device, the extension part 118 can be rotated to fold the blocking rod 105 and reduce space occupation.

Figure 9:
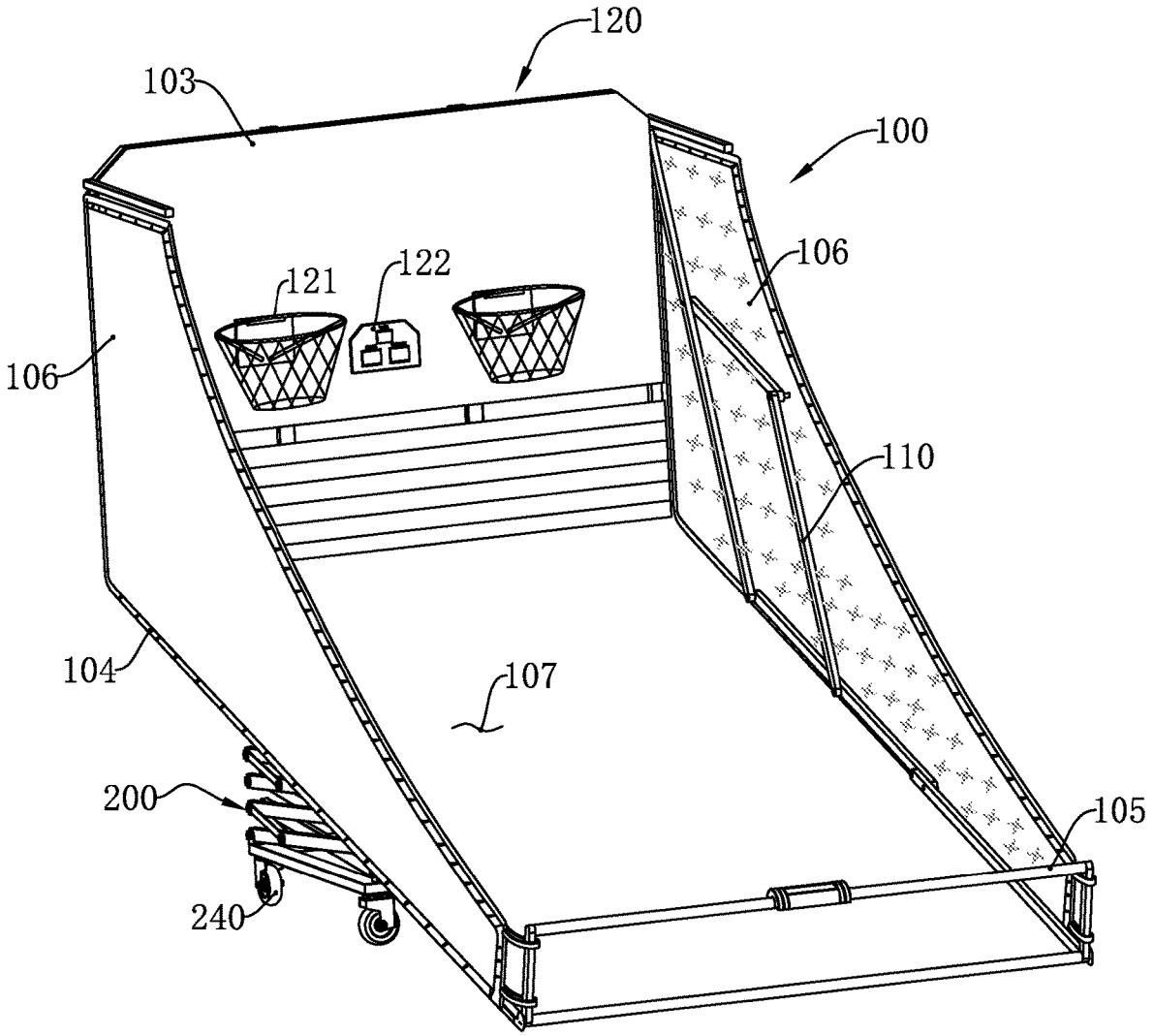
FIG. 9 is a schematic diagram of the throwing training device provided in a first embodiment of the present application.
Figure 11:
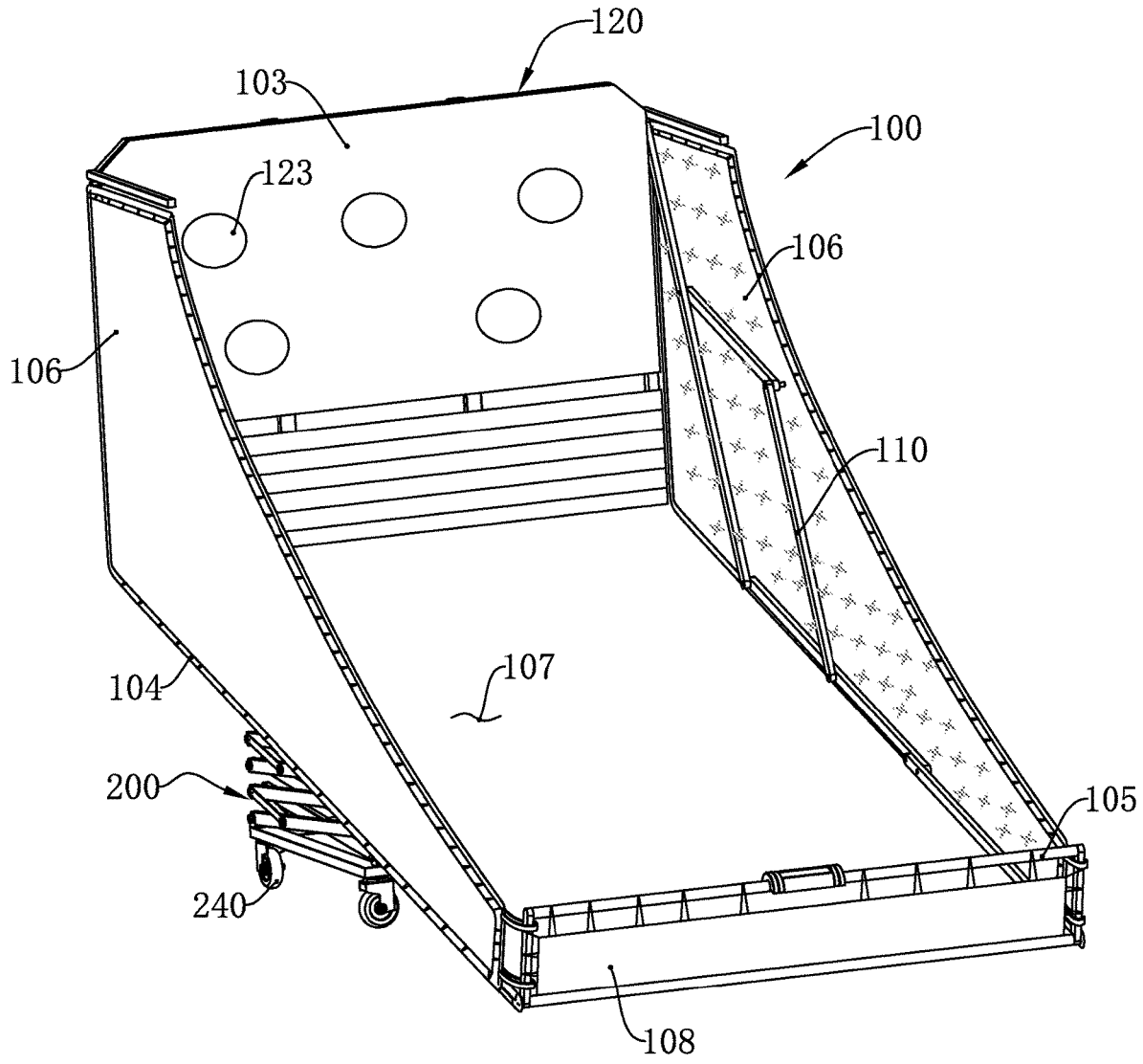
FIG. 11 is a schematic diagram of the throwing training device provided in another embodiment of the present application.

Referring to FIG. 9 or 11, in order to prevent a throwing direction of the thrown object from deviating from an area of the target component 120, or to prevent the thrown object from rebounding to outside through the baffle, the frame 100 further includes a side blocking member 106, the side blocking member 106 extends from one side of the standing frame 102 to a same side of the blocking rod 105.

Specifically, the side blocking member 106 is arranged to be attached to the connection rod component 110 to provide an auxiliary support for the side blocking member 106 with the connection rod component 110.

Specifically, as shown in FIG. 9 or 11, the frame 100 is provided with a bottom blocking member 107, the bottom blocking member 107 extends along the standing frame 102 to the blocking rod 105 to form the return area 130 for receiving the thrown object and returning it to the blocking rod 105.

In the present application, in order to facilitate a purpose of folding and unfolding, the bottom frame 104 may be composed of a flexible material, such as foldable hoses or other elastic materials. The side blocking member 106 is composed of a flexible material, such as plastic film, fabric, rope net, etc. The bottom blocking member 107 can be composed of a flexible material, such as plastic film, fabric, rope net, etc.

In the present application, the lifting seat 200 includes a base 210, a lifting mechanism 220, and a support seat 230. A positioning end of the lifting mechanism 220 is provided on an upper surface of the base 210, a lower surface of the support seat 230 is connected to an upper part of a movable end of the lifting mechanism 220, and the hinged component 300 is provided on the upper surface of the support seat 230. The lifting mechanism 220 drives the support seat 230 to raise or lower relative to the base 210 under the drive force so as to adjust a position of the frame 100 in a vertical direction.

Where, the drive force of the lifting mechanism 220 can be manually driven or driven by machinery, such as a motor, a drive cylinder, etc.

Figure 3:
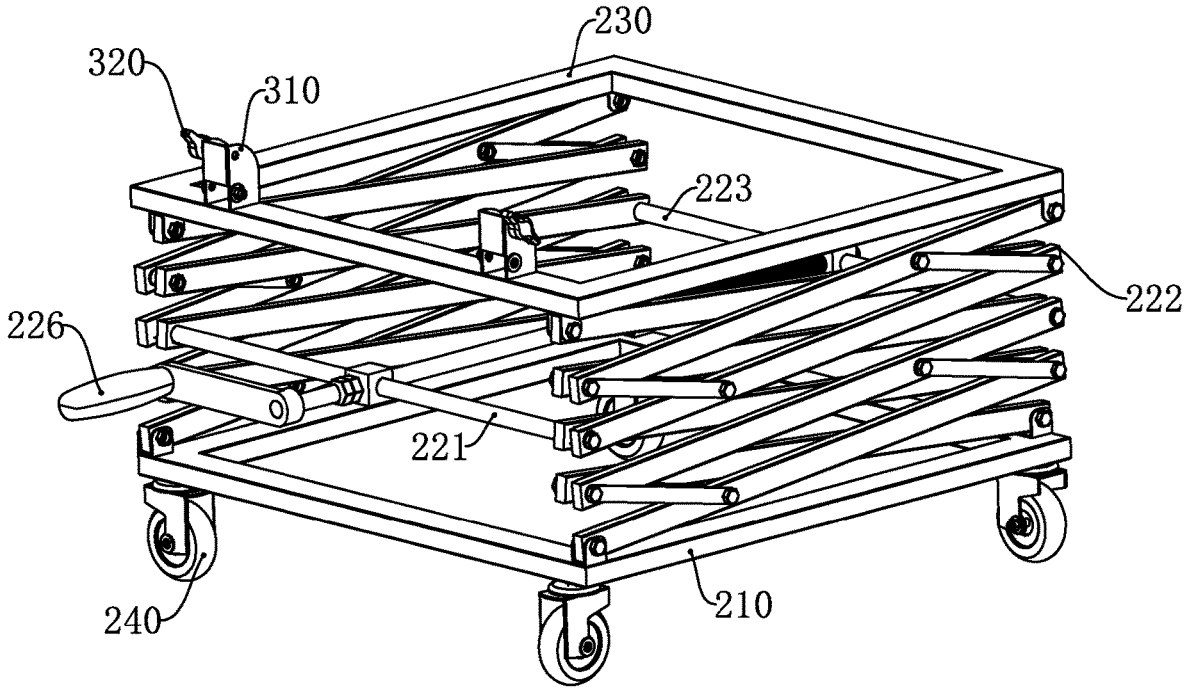
FIG. 3 is a schematic structural diagram of a lifting seat provided in an embodiment of the present application.
Figure 4:
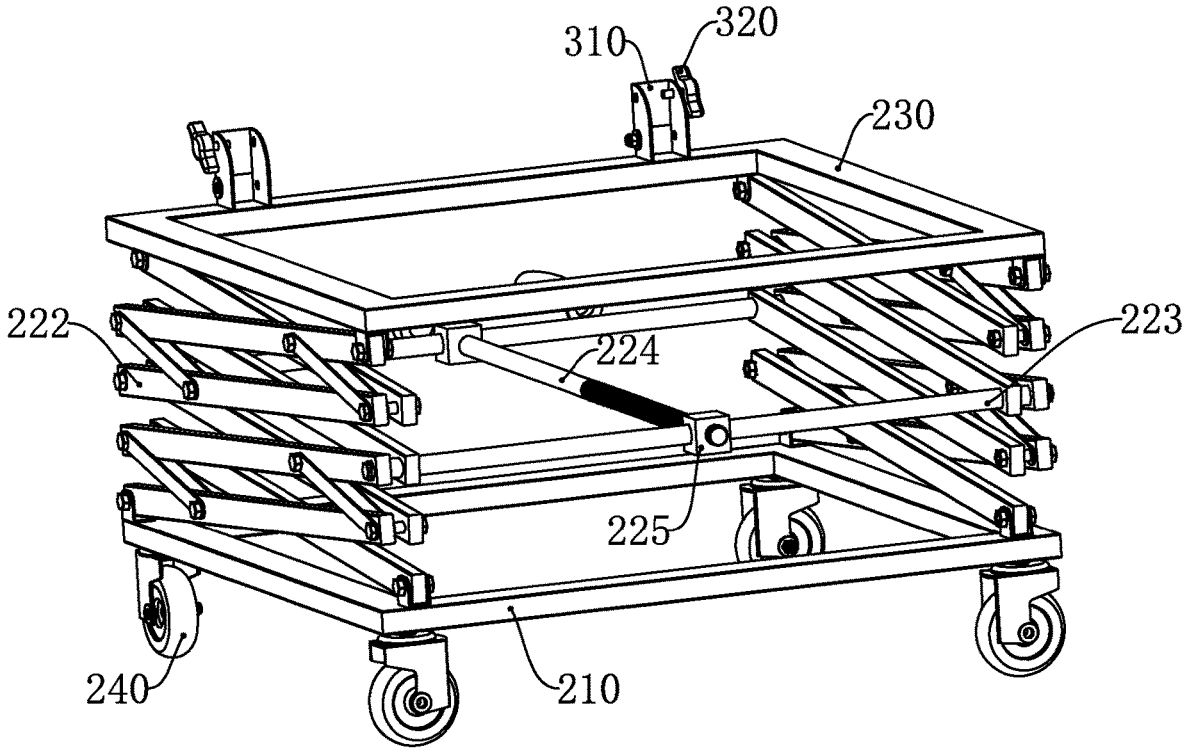
FIG. 4 is a schematic structural diagram in another view of the lifting seat provided in an embodiment of the present application.

As shown in FIGS. 3 and 4, a manually driven lifting seat 200 structure is provided. The lifting mechanism 220 adopts a scissor type lifting connection rod 222, the lifting connection rod 222 is provided with a main rod 221, a driven rod 223, and a drive rod 224. One end of the drive rod 224 is slidably coupled to the main rod 221, which can limit a relative rotation of the drive rod 224 with respect to the driven rod 223, while maintaining a relative position between them. The other end of the drive rod 224 is connected to the driven rod 223 through a drive block 225, which can drive the driven rod 223 to approach or move away from the main rod 221, thereby achieving a vertical expansion or folding the scissor type lifting connection rod 222. Specifically, the other end of the drive rod 224 can be provided with an external thread structure, and the drive block 225 is provided with an internal thread coupled with the external thread structure. When the drive rod 224 is rotated by a crank 226 for self-rotation, a meshing effect causes the drive block 225 to move, thereby driving a synchronous movement of the driven rod 223.

In other embodiments, the lifting mechanism 220 can be a push rod or other mechanism to achieve lifting in the vertical direction.

For ease of movement, a lower part of the lifting seat can also be provided with a set of wheels 240.

Figure 5:
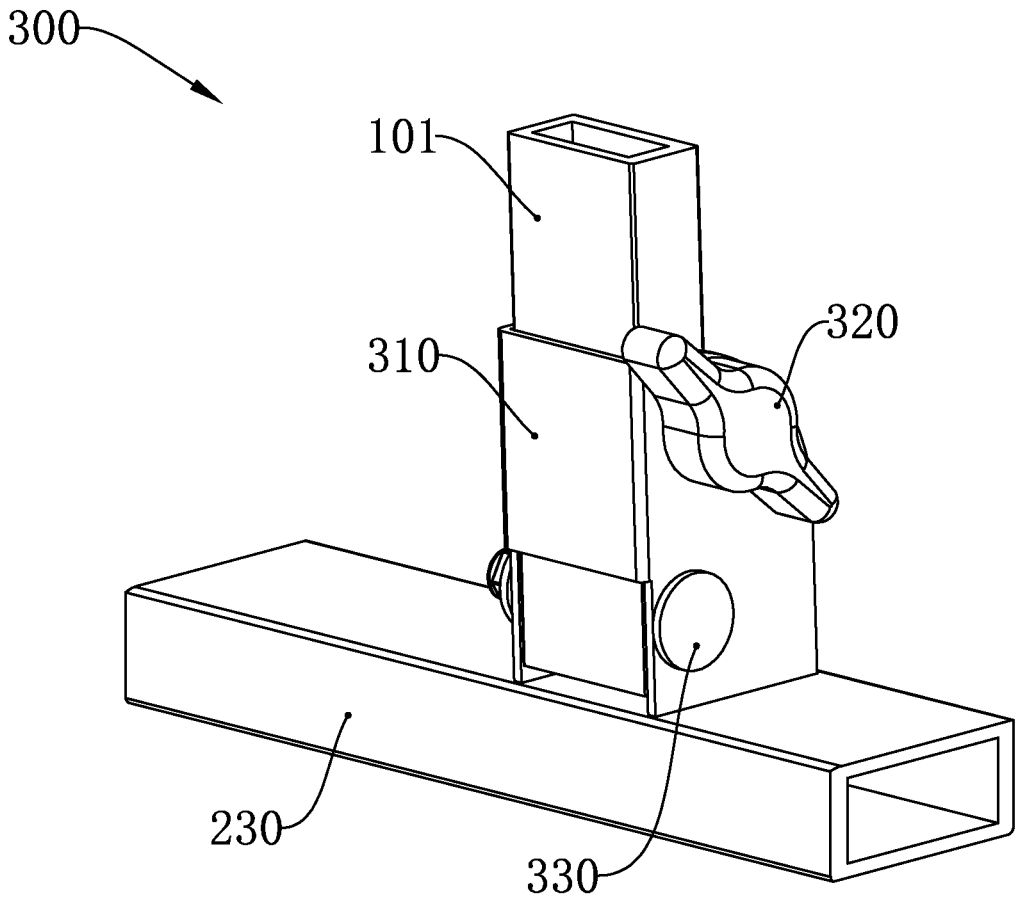
FIG. 5 is a schematic structural diagram of a hinged component provided in an embodiment of the present application.
Figure 6:
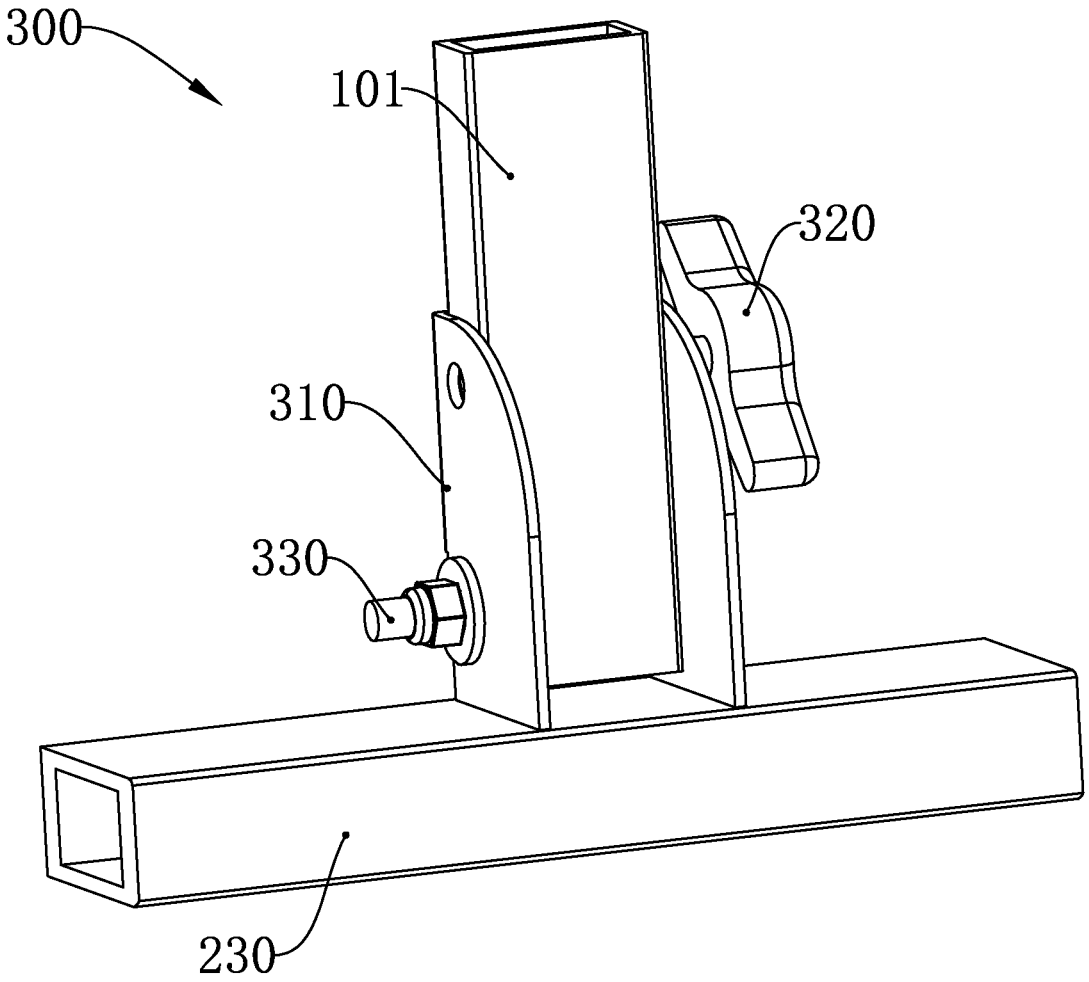
FIG. 6 is a schematic structural diagram in another view of the hinged component provided in an embodiment of the present application.

An implementation mode of a hinged component 300 is provided, as shown in FIGS. 5 and 6.

Specifically, the hinged component 300 includes a hinged base 310 and a locking member 320 and a pin 330 that are provided on the hinged base 310. The hinged base 310 is fixedly provided on the lifting seat 200, the hinged base 310 is hinged with the frame 100 through the pin 330; the locking member 320 is configured to form a connection or separation with the frame 100 to fix or rotate the frame 100 relative to the hinged base 310.

Specifically, in one implementation mode, the locking member 320 may adopt a screw structure, which is engaged and connected to the hinged base 310. When it is necessary to fix the bracket 101, the locking member 320 is rotated and moved towards the bracket 101, and then abusing against the bracket 101. By a tightly fitting of the locking member 320 with the bracket 101, the fixation of the bracket 101 is achieved. When the bracket 101 needs to be moved, the locking member 320 is released in an opposite direction.

In another implementation mode, the locking member 320 may adopt a pin structure, and the bracket 101 is provided with a locking hole coupled with the locking member 320. When it is necessary to fix the bracket 101, the locking member 320 is moved towards the bracket 101, the locking member 320 is inserted into the locking hole of the bracket 101, and the bracket 101 is fixed by a cooperation of the locking member 320 with the locking hole of the bracket 101. When the bracket 101 needs to be moved, the locking member 320 is moved in the opposite direction.

The throwing training device provided in the present application can be applied to different throwing events.

FIG. 9 provides a schematic diagram of a training device for basketball throwing events. Where, the target component 120 further includes a basket 121, the basket 121 is provided on the baffle.

For easy storage, the basket 121 can be connected to the baffle using a folding structure.

Figure 10:
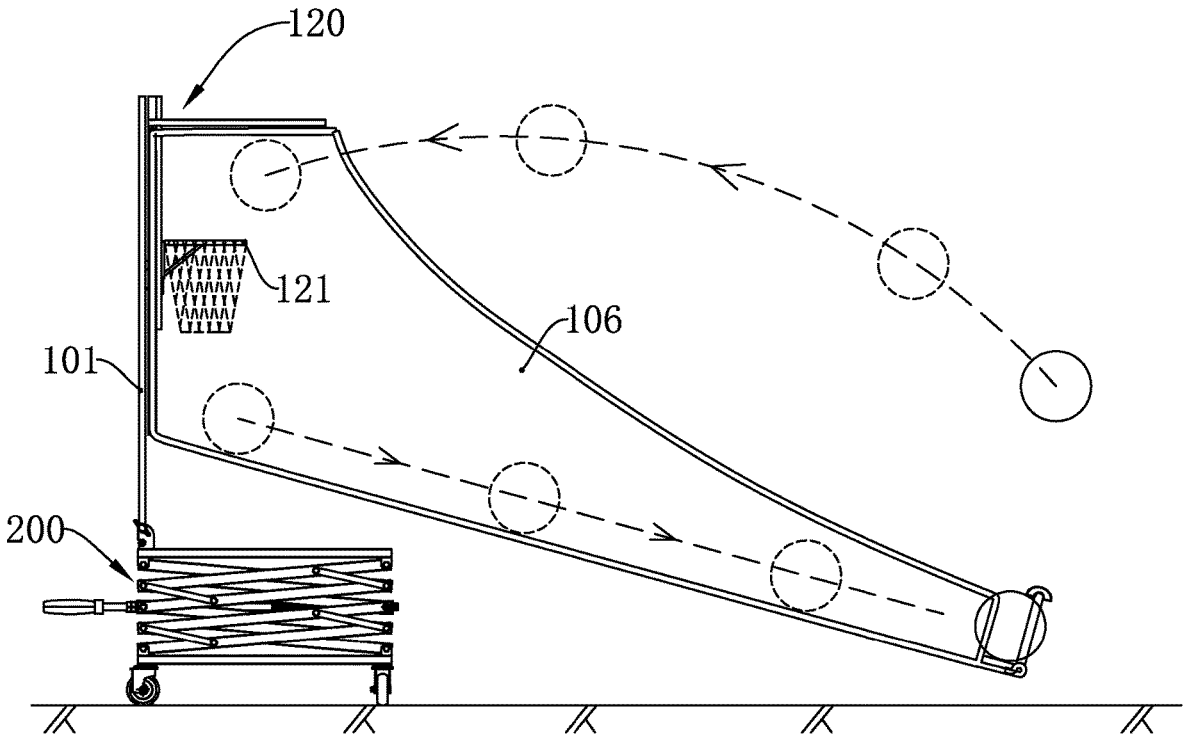
FIG. 10 is a side schematic diagram of the throwing training device provided in the first embodiment of the present application.

As shown in FIGS. 9 and 10, when the throwing training device is used for basketball throwing training or games, the user throws the basketball into the basket 121 of the target component 120 in a throwing area outside of the frame 100, and the basketball is returned to the throwing area through the bottom blocking member 107.

For the convenience of statistical display, the baffle can be provided with a display component 122, which, in combination with a sensor, can detect the number of shots made and display them.

FIG. 11 provides a schematic diagram of a training device for handball and rugby throwing events. Where, the target component 120 is provide with several targets 123.

Figure 12:
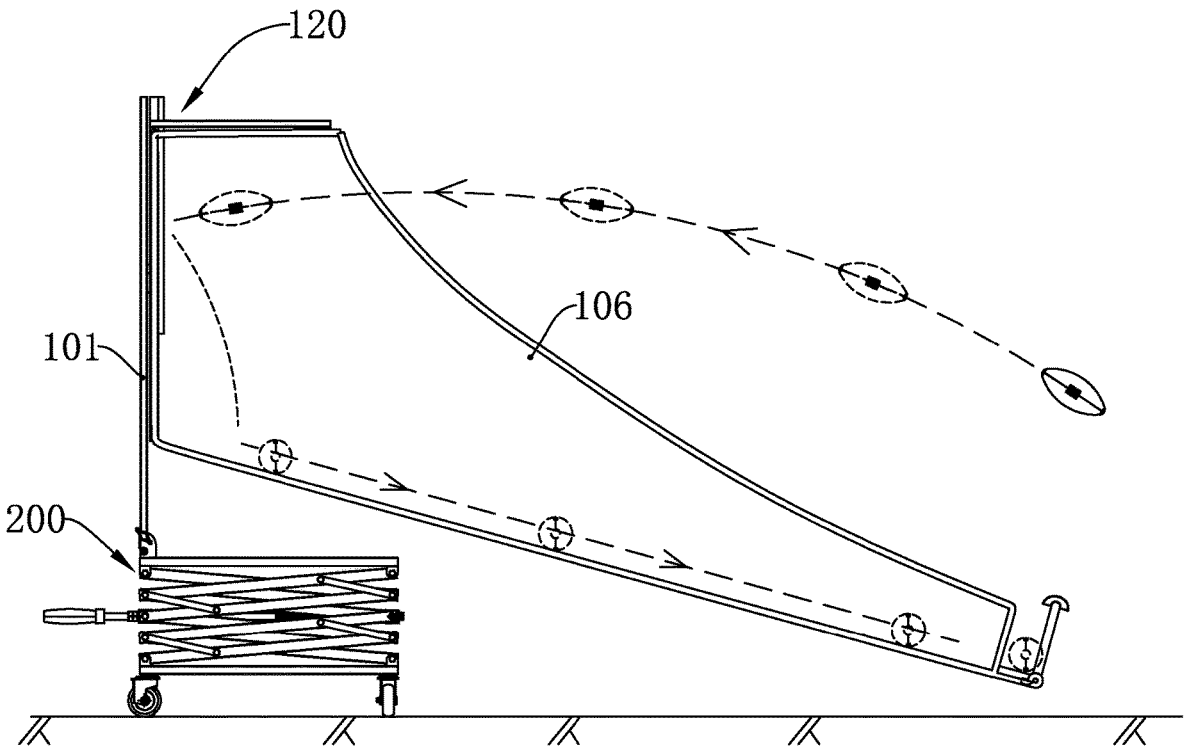
FIG. 12 is a side schematic diagram of the throwing training device provided in another embodiment of the present application.

As shown in FIGS. 11 and 12, when the throwing training device is used for handball, rugby throwing training or games, the user throws the object towards the target 123 of the target component 120 in the throwing area outside of the frame 100, and the object is returned to the throwing area through the bottom blocking member 107.

In order to intercept small-sized thrown object, the blocking rod 105 can also be provided with a front blocking member 108 to intercept the thrown object.

The above provides a detailed introduction to the throwing training device provided in the implementation modes of the present application, and applies specific embodiments to explain the principles and implementation modes of the present application. The above explanation is only used to help understand the methods and core mechanisms of the present application; meanwhile, for general technical personnel in this field, there may be changes in specific embodiments and application scope based on the ideas of the present application. In summary, the content of this specification should not be understood as a limitation on the present application.

What is claimed is:

1. A throwing training device, comprising:

a frame comprising a connection rod component and a target component, wherein the target component is connected to the connection rod component; the connection rod component is configured to have an unfolded configuration and a folded configuration, so that the frame has an unfolded configuration and a storage configuration; the frame limits a proximity position of a user in the unfolded configuration and allows the user to throw an object towards the target component; the frame folds components in the storage configuration to reduce space occupation;

a lifting seat provided below the frame, configured to lift and lower under a drive force, and synchronously drive the frame to lift and lower;

a hinged component, wherein the hinged component connects the frame and the lifting seat, the hinged component is configured to fix the frame to the lifting seat and to move the frame around the hinged component.

2. The throwing training device according to claim 1, wherein the frame further comprises a bracket, a standing frame, and a baffle; a lower end of the bracket is hinged with the hinged component, the standing frame is fixedly connected to the bracket, the baffle is provided at one surface of the standing frame, the standing frame and baffle are constructed as a main structure of the target component.

3. The throwing training device according to claim 2, wherein the frame comprises at least one set of connection rod components, the connection rod components are provided on one side of the standing frame.

4. The throwing training device according to claim 3, wherein the other end of the frame far from the standing frame is provided with a blocking rod for intercepting a thrown object returned from a return area.

5. The throwing training device according to claim 4, wherein the frame further comprises a side blocking member, the side blocking member extends from one side of the standing frame to a same side of the blocking rod.

6. The throwing training device according to claim 4, wherein the frame is provided with a bottom blocking member, the bottom blocking member extends along the standing frame to the blocking rod to form the return area for receiving the thrown object and returning the thrown object to the return area of the blocking rod.

7. The throwing training device according to claim 2, wherein the frame comprises a bottom frame for constructing a return area, the bottom frame is provided at a lower part of the frame, one end of the bottom frame is connected to the standing frame; when the frame is in unfolded configuration, the bottom frame tilts downwards with a horizontal line as a reference.

8. The throwing training device according to claim 2, wherein the target component further comprises a basket, the basket is provided on the baffle.

9. The throwing training device according to claim 1, wherein the lifting seat comprises a base, a lifting mechanism, and a support seat; a positioning end of the lifting mechanism is provided on an upper surface of the base, a lower surface of the support seat is connected to an upper part of a movable end of the lifting mechanism, the hinged component is provided on an upper surface of the support seat;

the lifting mechanism drives the support seat to raise or lower relative to the base under an action of a drive force to adjust a position of the frame in a vertical direction.

10. The throwing training device according to claim 1, wherein the hinged component comprises a hinged base, and a locking element and a pin that are provided on the hinged base, the hinged base is fixedly provided on the lifting seat, the hinged base is hinged with the frame through the pin; the locking member is configured to form a connection or separation with the frame to fix or rotate the frame relative to the hinged base.

11. The throwing training device according to claim 1, wherein the target component comprises several targets, the several targets are provided on one surface of the baffle.

* * * * *